US009714162B2

(12) United States Patent
Hecht et al.

(10) Patent No.: US 9,714,162 B2
(45) Date of Patent: Jul. 25, 2017

(54) MIXING NOZZLE FOR A BLENDED BEVERAGE FOR A MULTIPLE FLAVOR BEVERAGE DISPENSING SYSTEM

(71) Applicant: Automatic Bar Controls, Inc., Vacaville, CA (US)

(72) Inventors: Thomas R. Hecht, Winters, CA (US); Richard A. Martindale, Vacaville, CA (US); Bret D. Baker, Vacaville, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 0 days.

(21) Appl. No.: 14/797,051

(22) Filed: Jul. 10, 2015

(65) Prior Publication Data

US 2016/0009540 A1 Jan. 14, 2016

Related U.S. Application Data

(60) Provisional application No. 62/023,115, filed on Jul. 10, 2014.

(51) Int. Cl.
*B67D 1/00* (2006.01)
*B67D 7/74* (2010.01)

(52) U.S. Cl.
CPC ..... *B67D 1/0044* (2013.01); *B67D 1/0048* (2013.01); *B67D 1/005* (2013.01); *B67D 1/0021* (2013.01); *B67D 7/74* (2013.01)

(58) Field of Classification Search
CPC .... B67D 1/005; B67D 1/0044; B67D 1/0048; B67D 1/0021; B67D 7/74
See application file for complete search history.

(56) References Cited

U.S. PATENT DOCUMENTS 4,753,370 A * 6/1988 Rudick ..... B67D 1/0051 222/105
4,928,854 A * 5/1990 McCann ..... B67D 1/005 222/129.1
5,203,474 A * 4/1993 Haynes ..... B67D 1/005 222/129.1
5,549,222 A * 8/1996 Schroeder ..... B67D 1/0044 222/129.1
5,607,083 A * 3/1997 Vogel ..... B67D 1/0044 222/129.1
6,253,963 B1 7/2001 Tachibana
6,877,635 B2 4/2005 Stratton
(Continued)

FOREIGN PATENT DOCUMENTS

EP 0602627 A1 6/1994

OTHER PUBLICATIONS

International Search Report and Written Opinion mailed Sep. 9, 2015, from International Application No. PCT/US2015/040028 (13 pages).

*Primary Examiner* — Frederick C Nicolas
(74) *Attorney, Agent, or Firm* — Kilpatrick Townsend & Stockton LLP

(57) ABSTRACT

A beverage dispensing mixing nozzle for mixing a multi-component beverage mixture. The nozzle has a disruption plate for slowing and dispersing a dispensed fluid into an adjacent expansion region. The disruption plate and floor of the expansion region have turbulence-inducing surfaces to aid in mixing the fluid.

13 Claims, 6 Drawing Sheets

(56) References Cited

U.S. PATENT DOCUMENTS

| | | | | |
|---|---|---|---|---|
| 6,983,863 | B2 * | 1/2006 | Santy, Jr. | B67D 1/0043 222/129.1 |
| 7,559,440 | B2 | 7/2009 | Rueschhoff et al. | |
| 7,578,415 | B2 * | 8/2009 | Ziesel | B67D 1/0051 222/129.1 |
| 8,091,737 | B2 * | 1/2012 | Smeller | B67D 1/0044 222/1 |
| 8,528,786 | B2 * | 9/2013 | Gates | B67D 7/74 222/1 |
| 8,820,580 | B2 * | 9/2014 | Ziesel | B67D 1/0044 222/129.1 |
| 2007/0131715 | A1 | 6/2007 | Minard et al. | |

* cited by examiner

MIXING NOZZLE FOR A BLENDED BEVERAGE FOR A MULTIPLE FLAVOR BEVERAGE DISPENSING SYSTEM

CROSS-REFERENCES TO RELATED APPLICATIONS

This application claims the benefit of U.S. Provisional Application No. 62/023,115, filed Jul. 10, 2014, the entirety of which is incorporated by reference herein.

BACKGROUND

The invention relates to nozzles used with beverage dispensing systems. In particular, the invention relates to nozzles for beverage dispensing systems where multiple beverage components are concurrently dispensed through the nozzle to a container. These nozzles are used to direct the fluid beverage components in an organized fashion into a container, often times by a consumer. The nozzles must be able to dispense the beverage components without a detrimental carbonation loss.

Beverage dispensing systems are commonly used in a wide variety of locales, including restaurants, snack bars, convenience stores, movie theaters, and any business where beverages are served. These beverage dispensing systems often dispense a variety of beverages of differing types and flavors, such as flavored carbonated sodas, iced tea, water, or even alcoholic beverages. Typically, such devices use a post mix dispenser and a nozzle that directs and partially mixes a beverage additive (e.g., a flavored syrup) with a base beverage fluid (e.g., water or soda) before discharging the beverage into a beverage container. Many such beverage dispensing systems, often referred to as a beverage tower, utilize a dedicated nozzle for each flavor, but other systems utilize a single nozzle for dispensing multiple different beverage flavors depending on the needs of the end user.

Regardless of whether a single nozzle is used for multiple beverage mixes or if a nozzle is used for each single beverage flavor, conventional beverage dispensing nozzles only partially mix the beverage base and beverage additive prior to dispensing the mixed beverage to a container. While mixing occurs in the beverage cup, the beverage mixture, as it exits the nozzle and flows to the cup, sometimes has a streaked appearance. This is particularly noticeable in beverages where a dark additive is mixed with a clear base such as when a cola beverage is mixed, where the additive is a dark brown, and the soda water base is clear. Because current nozzles, when dispensing the exemplary cola beverage, do not completely mix the beverage, brown and clear streaks will appear in the partially mixed beverage stream as it is dispensed into a container.

The nature of the above drawbacks can be understood more fully by referencing one type of conventional device, commonly used in standard beverage dispensing applications, shown in FIGS. 1-4. FIGS. 1-4 all depict a conventional nozzle 2. The convention nozzle 2 has an inlet 4 at an upstream side of the nozzle 2, which is connectable to a beverage dispensing system (not shown). The conventional nozzle 2 also has outlet 6 at the downstream end of the nozzle 2.

FIG. 3 shows a cross-section view of the conventional nozzle 2 where the internal walls of the nozzle can be seen. Near the inlet 4 of the nozzle, the internal walls are vertical. As a fluid moves through the nozzle in the downstream direction, internal nozzle wall 16 funnels the fluid stream into a narrower nozzle passage. This funneling causes a partial mixing of the beverage components at the outer edge of the beverage fluid stream. As the fluid stream proceeds in the downstream direction, internal nozzle wall 16 further funnels the fluid stream. The funnel shape of wall 16 is convex and causes some additional partial mixing of the beverage fluid, but again, only near the outer edges of the fluid stream. The funneling also functions to organize the multiple beverage components into a smaller controlled stream for dispensing. As the beverage fluid further proceeds in the downstream direction, it finally reaches the vertical internal wall 16 and is dispensed into a suitable beverage container (not shown).

The beverage-dispensing nozzle of the prior art, as shown in FIGS. 1-4, dispenses a laminar flowing partially mixed beverage. The dispensed beverage is laminar, i.e. not uniformly mixed across its flow path, and includes streaking which is the combined flow of the dark beverage component additive, such as a dark colored cola, with the light colored beverage base such as the carbonated water which is colorless. This laminar flow streaking is caused by separate dispensing points for each of the beverage base and the beverage additive at the discharge from the dispensing system to the nozzle and the inability of the conventional nozzle to sufficiently mix the beverage components.

Accordingly, it is desirable to develop a nozzle that overcomes the aforementioned deficiencies of conventional beverage dispensing nozzles.

BRIEF SUMMARY OF THE INVENTION

Some embodiments of the present invention are related to . . . a dispensing nozzle with an entry region adapted to connect to a fluid outlet. The entry region has a first internal wall with a first inner diameter where the first internal wall extends along an axis from a fluid entrance. An expansion region is connected to the entry region that has a second inner wall extending along the axis from the first inner wall. The second inner wall has a second inner diameter and the second inner diameter is greater than the first inner diameter. An exit region is connected to the expansion region and has a third internal wall extending along the axis from the second internal wall. The third internal wall has a third inner diameter that is less than the second inner diameter and the third internal wall extends along the axis to a fluid exit. A fluid stream disruption plate extends across the axis at a portion between the second and third internal walls. The second inner wall and fluid stream disruption plate have a turbulence-inducing surface.

In many embodiments, the stream disruption plate includes a central opening. In many embodiments, the stream disruption plate of the dispensing nozzle includes at least one vent apart from the central opening. In many embodiments, the stream disruption plate of the dispensing nozzle includes a plurality of vents circumferentially located about the central opening.

In many embodiments, the stream disruption plate is angled toward the axis as it extends toward the exit region. In many embodiments, at least a portion of the third inner wall is angled in the direction of the axis.

In many embodiments, the second inner wall in the expansion region is curved as it extends from the first inner wall away from the axis and is angled toward the axis as it extends to the third inner wall in the direction of the fluid exit. In many embodiments, a portion of the third inner wall of the exit region is angled in the direction of the axis as it extends from the second inner wall and toward the fluid exit, the portion of third inner wall having a turbulence-inducing surface. In many embodiments, the turbulence-inducing surface is a stepped surface.

Further understanding of the nature and the advantages of the embodiments disclosed and suggested herein may be realized by reference to the remaining portions of the specification and the attached drawings.

DETAILED DESCRIPTION OF THE INVENTION

Figure 1:
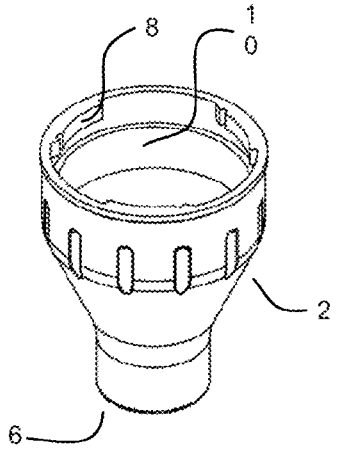
PRIOR ART FIG. 1
FIG. 1 illustrates a perspective view of a conventional beverage dispensing nozzle used in multiple beverage dispensing systems according to the prior art.
Figure 2:
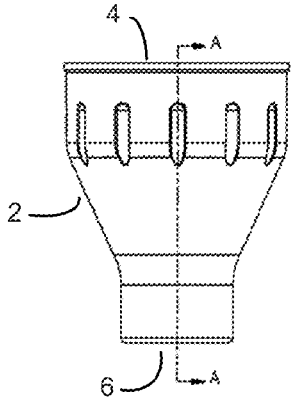
PRIOR ART FIG. 2
FIG. 2 illustrates a vertical view of the conventional beverage dispensing nozzle of FIG. 1.
Figure 3:
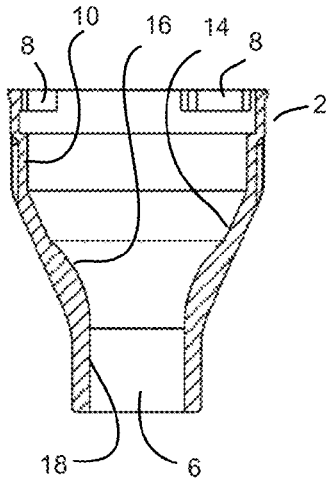
PRIOR ART FIG. 3
FIG. 3 illustrates a vertical cross-section view along Section A-A of FIG. 1.
Figure 4:
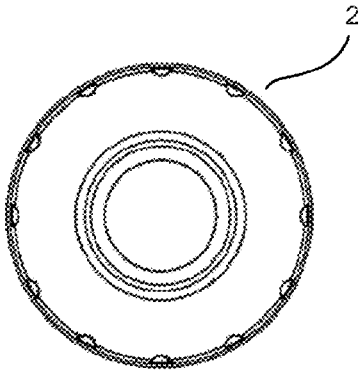
PRIOR ART FIG. 4
FIG. 4 illustrates a top view of the conventional beverage dispensing nozzle of FIG. 1.
Figure 5:
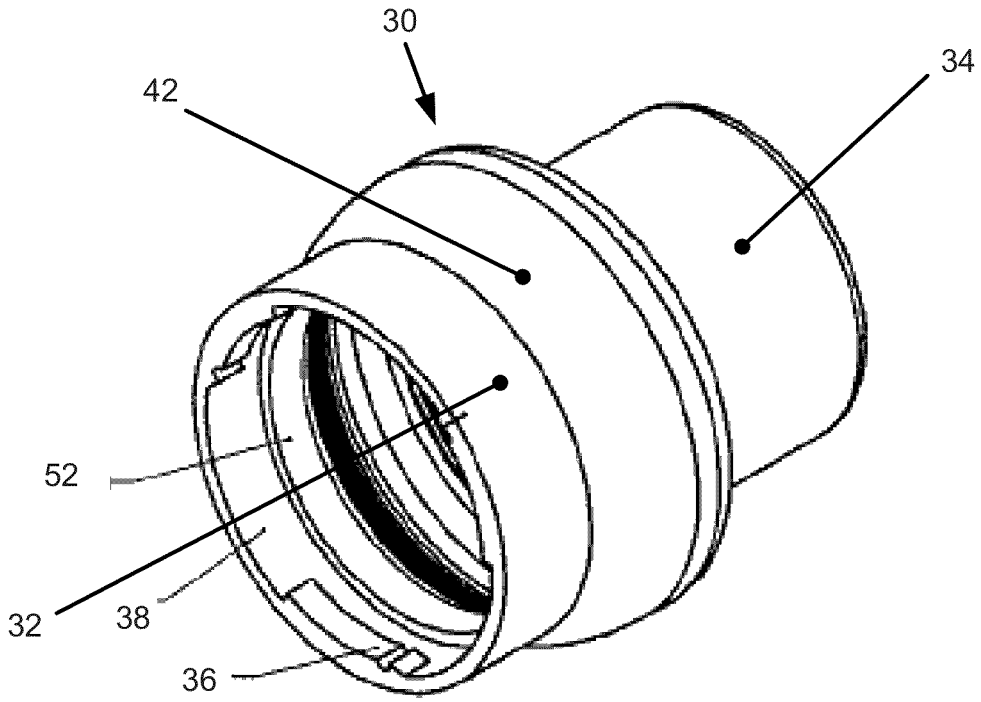
FIG. 5 illustrates a top perspective view of a beverage dispensing nozzle, in accordance with many embodiments of the present invention.

FIG. 5 shows a perspective view of a nozzle 30 in accordance with one embodiment of the present invention. The nozzle 30 has an inlet located at an upstream side of the nozzle. Adjacent the inlet, at the interior of the nozzle 30, within the entry chamber 32, there is a connection tab 36, a diffuser mating surface 38 and an internal raised surface 52. The connection tab 36 is made up of a "twist-lock" feature arrayed either singularly or plurally about the inner surface of the nozzle 30. Other ways for connection include snap, friction, screw, and compression, among others. When the nozzle is connected to a beverage-dispensing system diffuser, an o-ring (not shown) may be used between the diffuser and the diffuser mating surface 38 and the raised surface 52, to create a liquid proof seal. An expansion chamber 42 adjoins the entry chamber. At the bottom of the expansion chamber is a disruption plate 40, seen in FIG. 6, that extends across the ordinary fluid path that a beverage fluid flows through the nozzle. The configuration of the disruption plate in conjunction with the expansion chamber, allows for the flow of the beverage fluid through the entry chamber region and then into the expansion chamber to disperse and expand after the beverage fluid has interacted with the disruption plate 40.

Figure 6:
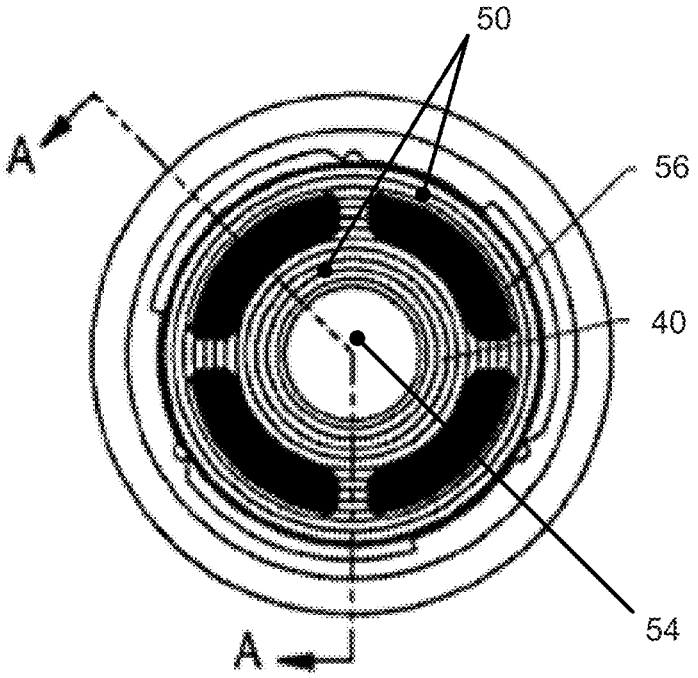
FIG. 6 illustrates a top view of the beverage dispensing nozzle of FIG. 5.
Figure 7:
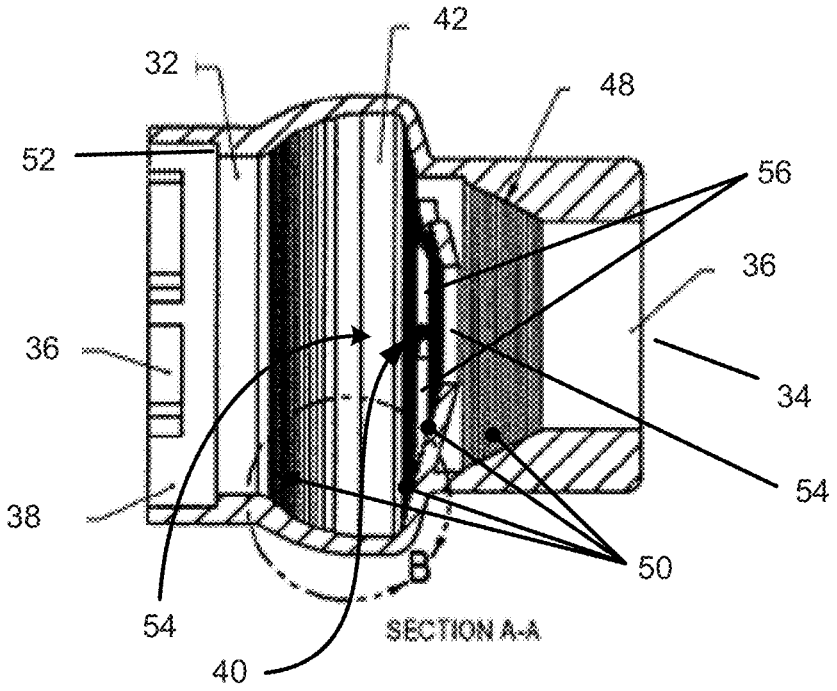
FIG. 7 illustrates a cross-section view along lines A-A of FIG. 6.

FIG. 6 shows a turbulence-inducing surface 50 on the disruption plate 40 which aids in further slowing the flow of the fluid and induces mixing of the distinct and/or partially mixed beverage base and beverage additive fluids. The turbulence-inducing surface 50 is formed to create sufficient turbulence to mix the beverage base and beverage additive fluids without overmixing the beverage combination to lower the carbonation content of the beverage too much, resulting in a "flat" beverage. There are also turbulence-inducing surfaces 50 on the upper portion of the expansion region sidewall 48 as can be seen in FIG. 7. Here, the turbulence-inducing surface 50 are a plurality of terraces or steps, defined by edges that decrease in diameter in the flow direction. However, the shape of the turbulence-inducing surface 50 is not limited to the circular terraces and can take other forms, such as a roughened or dimpled surface.

Figure 8:
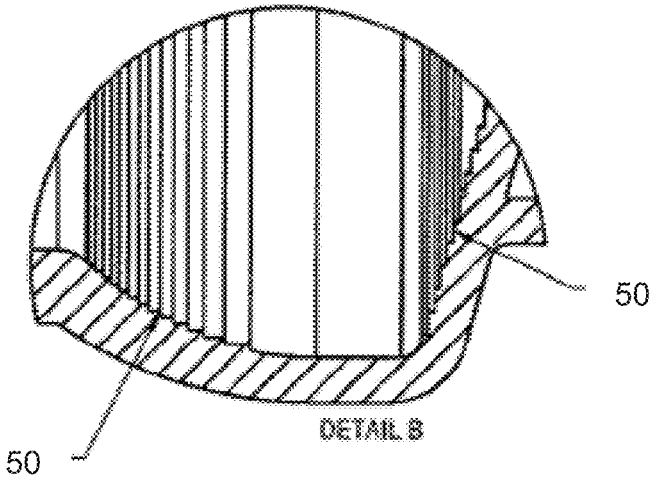
FIG. 8 illustrates a detailed cross-section view as identified by Section B of FIG. 7 of the beverage dispensing nozzle.

FIG. 7 shows a section view of the beverage dispensing nozzle 30 as identified by Section A-A of FIG. 6. In this view, the turbulence-inducing surfaces 50 on the expansion region 42, both on the top and bottom of the expansion region 42, and on the disruption plate 40, can be seen. Moreover, the cross-section of the fluid disruption plate 40 can be seen in greater detail. FIG. 8 shows a close-up of the turbulence-inducing surface 50 on the upper portion of the expansion region sidewall 48 and the fluid disruption plate 40.

The fluid stream disruption plate 40 is angled in a funneling fashion toward the central axis of the nozzle in the direction of the fluid discharge, thus, allowing mixed fluid to flow towards a central opening 54. In addition to a central opening 54 of the disruption plate, a plurality of vents 56 penetrate the disruption plate 40 to ensure mixed beverage fluid does not back up or clog the nozzle, ensuring adequate drainage from the expansion region 42. As can be seen in FIG. 5, the plurality of openings 7 are elongated curved slots which are circumferentially located around, but apart from, the central opening 54. As can be seen, there are four equally sized and spaced slots but other embodiments are possible and a different configuration of vents and openings can be used.

After the beverage components are mixed within the expansion chamber, they flow past the exit region 36, where further mixing is performed as the fluid funnels to the discharge point 34 of the nozzle by virtue of angled internal wall 48 of the exit region 36 which also has a turbulence-inducing surface 50. Here, the turbulence-inducing surface 50 of the expansion region 40, the disruption plate 40 and the upper internal wall 48 of the exit region are stepped surfaces, as can be seen in the cross-section of the nozzle in FIG. 8, however it can be appreciated by one skilled in the art that a variety of different surfaces may be utilized on all or separately on each of the turbulence-inducing surface 50 of the expansion region 40, the disruption plate 40 and the upper internal wall 48 of the exit region.

Figure 9A:
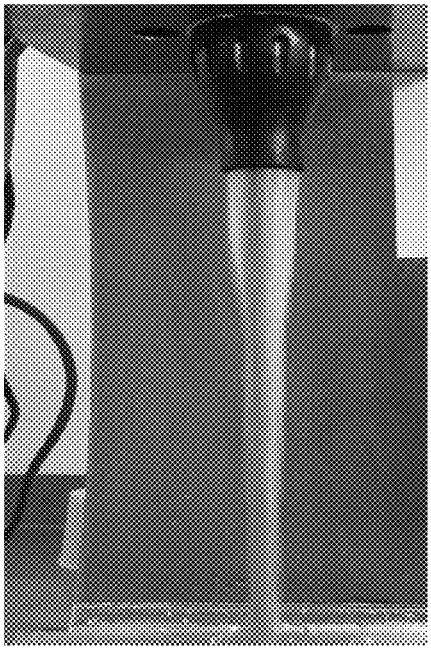
FIGS. 9A and 9B illustrates the flow of a beverage from both a prior art nozzle as seen in FIG. 9A and from the nozzle of the present invention as seen in FIG. 9B.
Figure 9B:
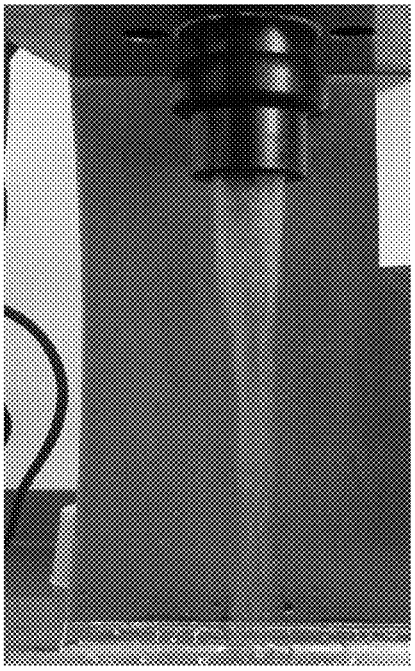

FIGS. 9A and 9B illustrate the flow of a beverage from both a prior art nozzle, as seen in FIG. 9A, and from the nozzle of the present invention, as seen in FIG. 9B. As can be seen, the flow of mixed beverage from the prior art nozzle in FIG. 9A has a streaking or unmixed appearance leading some users to misinterpret whether the final beverage is thoroughly mixed, which may lead to the user discarding an otherwise good beverage causing waste. The appearance of the dispensed beverage flow from a nozzle in conformance with the present invention, as shown in FIG. 9B, is uniform since thorough mixing occurs given the configuration of the mixing nozzle and users are not unnecessarily tempted to waste dispensed beverage given the appearance of the dispensed beverage flow from the mixing nozzle in conformance with the present invention.

The above description is illustrative and is not restrictive. A recitation of "a", "an" or "the" is intended to mean "one or more" unless specifically indicated to the contrary. Many variations of the disclosure will become apparent to those skilled in the art upon review of the disclosure. One or more features from any embodiment described herein may be combined with one or more features of any other embodiment without departing from the scope of the disclosure. The scope of the disclosure should, therefore, be determined not with reference to the above description, but instead should be determined with reference to the pending claims along with their full scope or equivalents.

What is claimed is:

1. A beverage dispensing nozzle comprising:

an entry chamber adapted to connect with a beverage dispenser outlet, the entry chamber having a first internal wall having a first inner diameter, the first internal wall extending along an axis from a fluid entrance;

an expansion chamber in fluid communication with the entry chamber and having a second inner wall extending along the axis from the first internal wall, the second inner wall having a second inner diameter, the second inner diameter being greater than the first inner diameter;

an exit chamber in fluid communication with the expansion region and having a third internal wall extending along the axis from the second internal wall, the third internal wall having a third inner diameter that is less than the second inner diameter, the third internal wall extending along the axis to a fluid exit; and a fluid stream disruption plate extending across the axis at a position between the expansion chamber and the exit chamber wherein the second inner wall and fluid stream disruption plate have a turbulence-inducing surface; and wherein the fluid stream disruption plate has a central opening.

2. The beverage dispensing nozzle of claim 1 wherein the fluid stream disruption plate has at least one vent apart from the central opening.

3. The beverage dispensing nozzle of claim 1 wherein the fluid stream disruption plate has a plurality of vents circumferentially encircling the central opening.

4. The beverage dispensing nozzle of claim 3 wherein the each of the plurality of vents is an arced slot.

5. The beverage dispensing nozzle of claim 3 wherein the fluid stream disruption plate is funnel shaped.

6. The beverage dispensing nozzle of claim 4 wherein at least a portion of the third inner wall is funnel shaped.

7. The beverage dispensing nozzle of claim 6 wherein the second inner wall is curved as it extends from the first inner wall away from the axis and is angled toward the axis as it extends to the third inner wall in the direction of the fluid exit.

8. The beverage dispensing nozzle of claim 7 wherein a portion of the third inner wall is funnel shaped as it extends from the second inner wall and toward the fluid exit.

9. The beverage dispensing nozzle of claim 8 wherein the portion of third inner wall has a turbulence-inducing surface.

10. The beverage dispensing nozzle of claim 9 wherein the turbulence-inducing surface is a stepped surface.

11. The beverage dispensing nozzle of claim 9 wherein the turbulence-inducing surface is a ridged surface.

12. The beverage dispensing nozzle of claim 9 wherein the turbulence-inducing surface is a dimpled surface.

13. The beverage dispensing nozzle of claim 9 wherein the turbulence-inducing surface is a roughened surface.

* * * * *